United States Patent [19]

Martin

[11] 4,291,396

[45] Sep. 22, 1981

[54] DISCRETE AMPLITUDE SHADING FOR LOBE-SUPPRESSION IN DISCRETE ARRAY

[75] Inventor: Gordon E. Martin, San Diego, Calif.

[73] Assignee: The United States of America as represented by the Secretary of the Navy, Washington, D.C.

[21] Appl. No.: 114,780

[22] Filed: Jan. 24, 1980

[51] Int. Cl.[3] ..... H04R 1/32

[52] U.S. Cl. ..... 367/154; 367/905

[58] Field of Search ..... 367/153, 154, 155, 156, 367/905

[56] References Cited

U.S. PATENT DOCUMENTS 3,368,190 2/1968 Wilson et al. ..... 367/155

*Primary Examiner*—Richard A. Farley

*Attorney, Agent, or Firm*—Richard S. Sciascia; Ervin F. Johnston; John Stan

[57] ABSTRACT

A discrete transducer array of a plurality of discrete transducer elements, so connected as to achieve a good array directivity pattern with as narrow a beam width as possible for a given side lobe level, or as low a side lobe level as possible for a given beam width, or the most favorable combination of the two. This is to be done with the restriction that there is a discrete array of, say 24, elements that must be shaded discretely, for example by using a series-parallel combination of the elements.

A particularly favorable combination using 24 elements comprises: a series combination of the three elements at one end in series with the series combination of the three elements at the other end, each element having a relative voltage amplitude of 1/6; a series combination of the next two elements at each end in series together, each of the four elements having a relative voltage amplitude of $\frac{1}{4}$; a series combination of the next three elements at either end, each element having a relative voltage amplitude of $\frac{1}{3}$; and eight other adjacent pairs in the central region, each element having a relative voltage amplitude of $\frac{1}{2}$.

This shading method achieves side lobe levels below −25.7 db with a major lobe half-power beam width $\frac{1}{4}$ larger than the unshaded 24-element transducer. This transducer has optimum four-zone shading that incorporates the methods of this invention.

10 Claims, 5 Drawing Figures

| SECTION | 30 A′ | 30 B′ | 30 C′ | 30 C″ | 30 B″ | 30 A″ |
|---|---|---|---|---|---|---|
| AMPLITUDE | $\frac{1}{4}$ $\frac{1}{4}$ | $\frac{1}{2}$ $\frac{1}{2}$ $\frac{1}{2}$ $\frac{1}{2}$ | 1 1 1 1 1 1 | 1 1 1 1 1 1 | $\frac{1}{2}$ $\frac{1}{2}$ $\frac{1}{2}$ $\frac{1}{2}$ | $\frac{1}{4}$ $\frac{1}{4}$ |
| LOCATION | 1 2 | 3 4 5 6 | 7 8 9 10 11 12 | 13 14 15 16 17 18 | 19 20 21 22 | 23 24 |

FIRST MODIFICATION OF AMPLITUDE SHADING FOR TRANSDUCER WITH 24 ELEMENTS

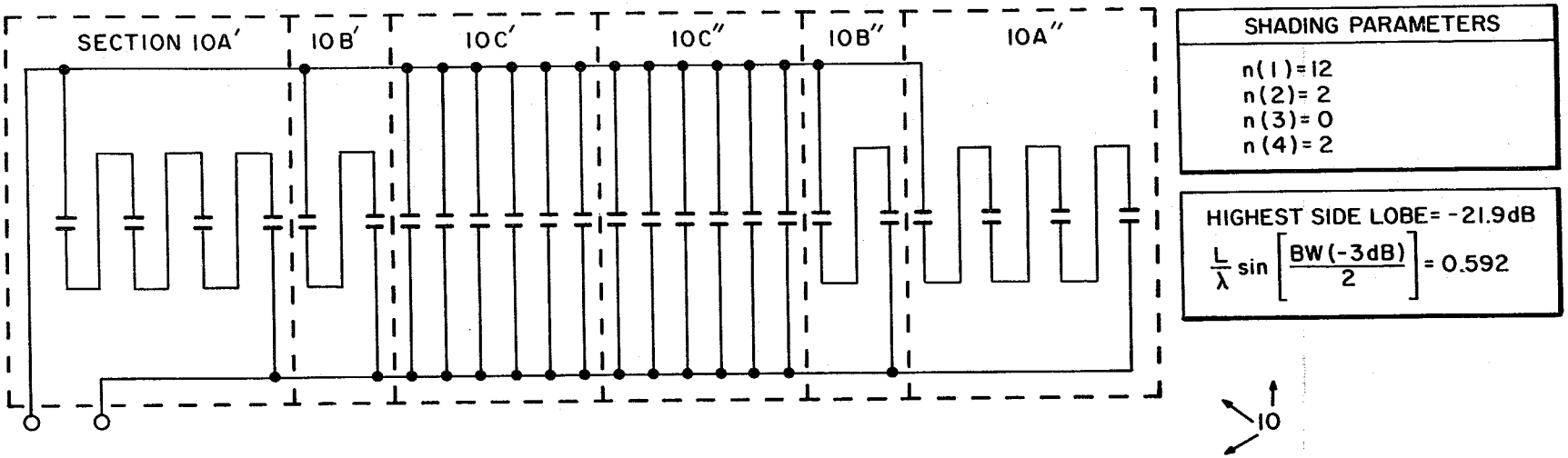
| SECTION | 10A' | 10B' | 10C' | 10C'' | 10B'' | 10A'' |
|---|---|---|---|---|---|---|
| AMPLITUDE | $\frac{1}{4}$ $\frac{1}{4}$ $\frac{1}{4}$ $\frac{1}{4}$ | $\frac{1}{2}$ $\frac{1}{2}$ | 1 1 1 1 1 1 | 1 1 1 1 1 1 | $\frac{1}{2}$ $\frac{1}{2}$ | $\frac{1}{4}$ $\frac{1}{4}$ $\frac{1}{4}$ $\frac{1}{4}$ |
| LOCATION | 1 2 3 4 | 5 6 | 7 8 9 10 11 12 | 13 14 15 16 17 18 | 19 20 | 21 22 23 24 |
FIG. 1. (PRIOR ART) AMPLITUDE SHADING TECHNIQUE FOR TRANSDUCER WITH 24 ELEMENTS.

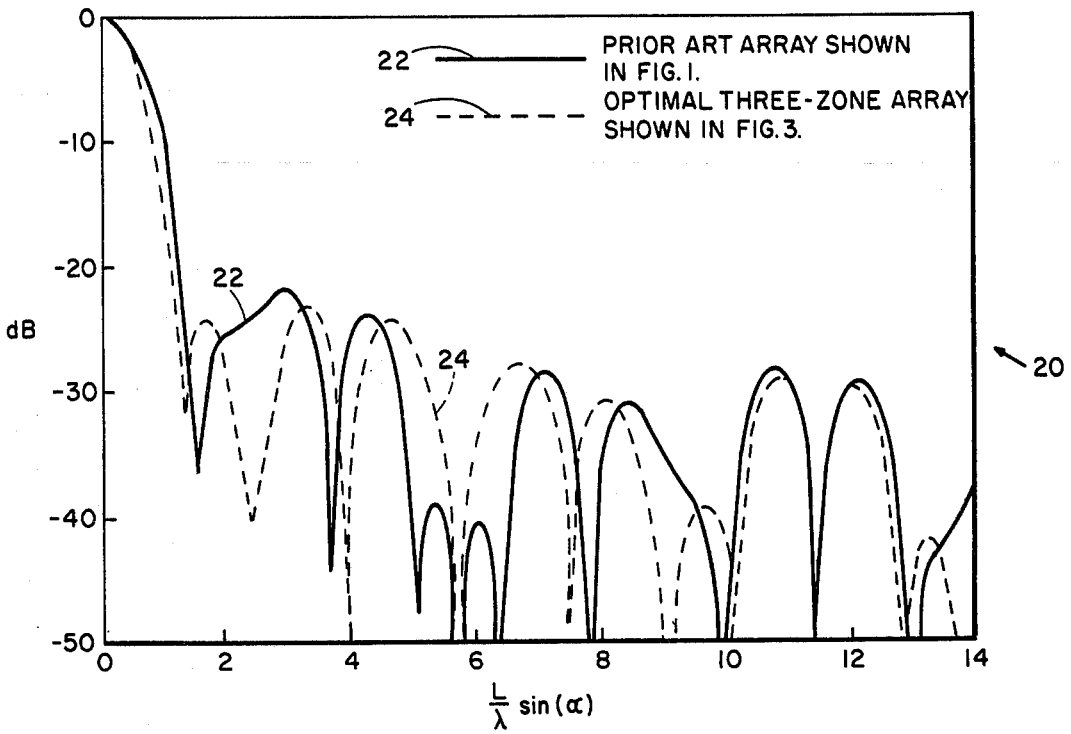
FIG. 2. DIRECTIVITY PATTERNS FOR DISCRETE ARRAYS.
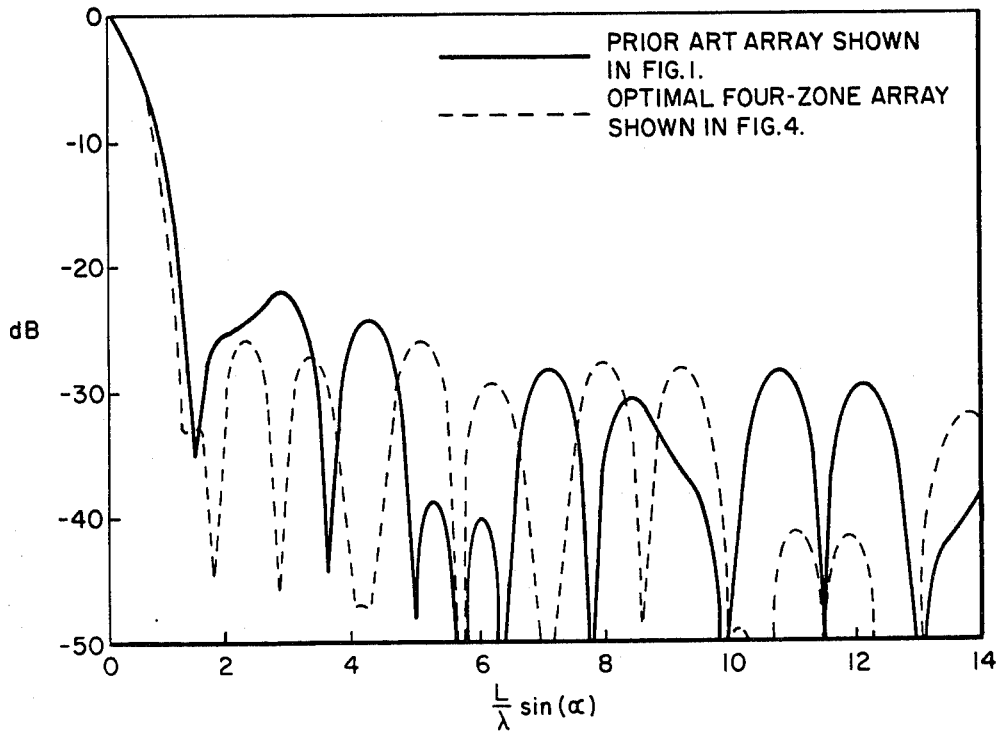
FIG. 5. DIRECTIVITY PATTERNS FOR DISCRETE ARRAYS.

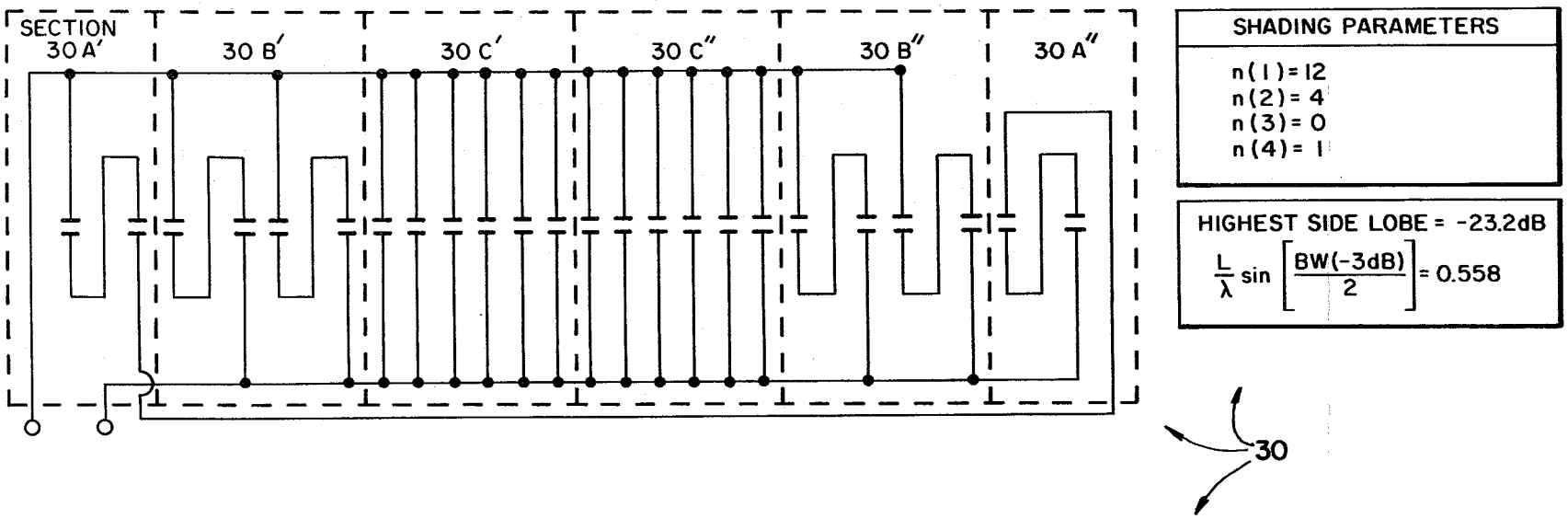
| SECTION | 30 A' | 30 B' | 30 C' | 30 C'' | 30 B'' | 30 A'' |
|---|---|---|---|---|---|---|
| AMPLITUDE | $\frac{1}{4}$ $\frac{1}{4}$ | $\frac{1}{2}$ $\frac{1}{2}$ $\frac{1}{2}$ $\frac{1}{2}$ | 1 1 1 1 | 1 1 1 1 | $\frac{1}{2}$ $\frac{1}{2}$ $\frac{1}{2}$ $\frac{1}{2}$ | $\frac{1}{4}$ $\frac{1}{4}$ |
| LOCATION | 1 2 | 3 4 5 6 | 7 8 9 10 11 12 | 13 14 15 16 17 18 | 19 20 21 22 | 23 24 |
FIG. 3. FIRST MODIFICATION OF AMPLITUDE SHADING FOR TRANSDUCER WITH 24 ELEMENTS.

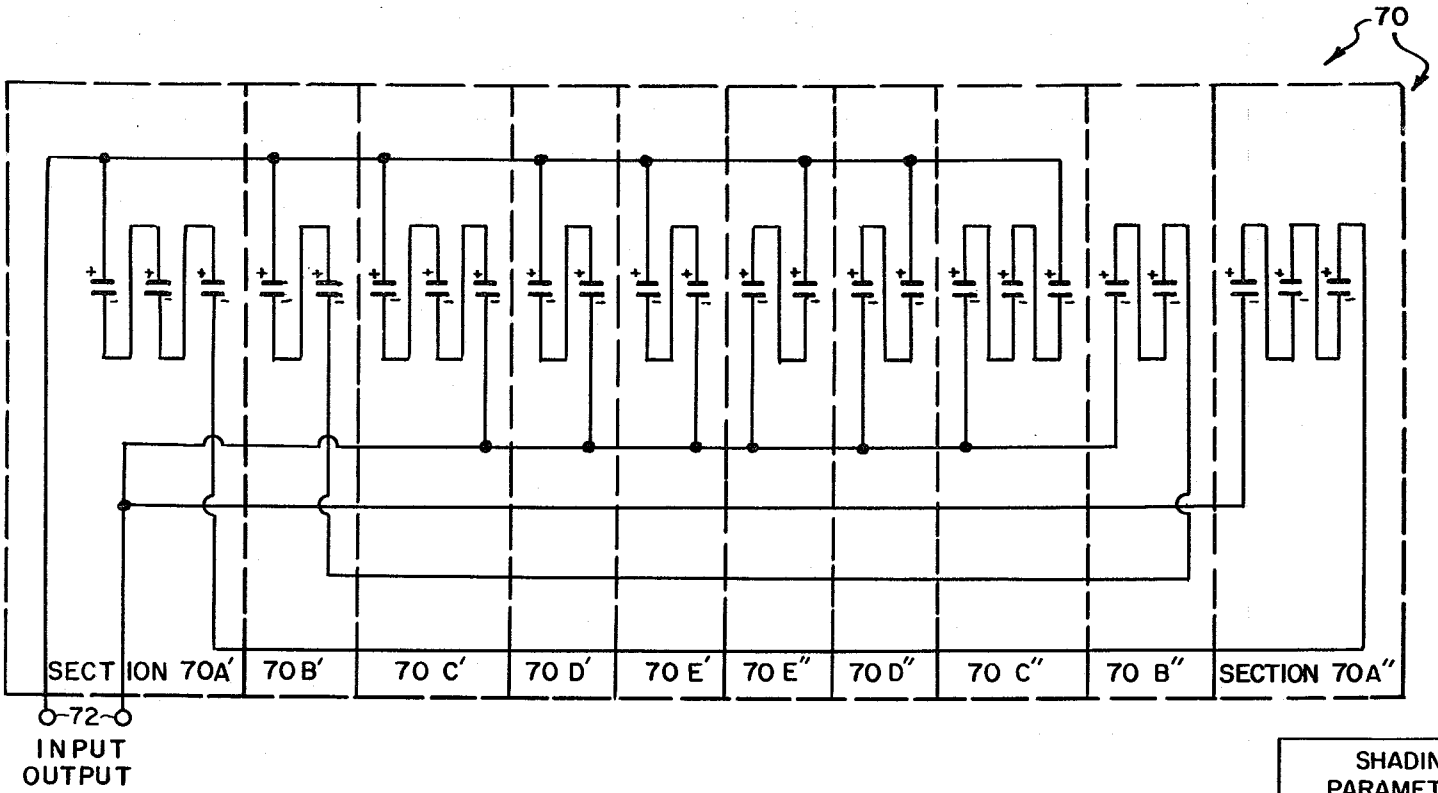

| SHADING PARAMETERS |
|---|
| n(1) = 0 |
| n(2) = 4 |
| n(3) = 2 |
| n(4) = 1 |
| n(5) = 0 |
| n(6) = 1 |

HIGHEST SIDE LOBE = -25.7dB $$\frac{L}{\lambda}\sin\left[\frac{BW(-3dB)}{2}\right] = 0.548$$

| SECTION | 70A' | 70B' | 70C' | 70D' | 70E' | 70E'' | 70D'' | 70C'' | 70B'' | 70A'' |
|---|---|---|---|---|---|---|---|---|---|---|
| AMPLITUDE | $\frac{1}{6}$ $\frac{1}{6}$ | $\frac{1}{4}$ $\frac{1}{4}$ | $\frac{1}{3}$ $\frac{1}{3}$ | $\frac{1}{2}$ $\frac{1}{2}$ | $\frac{1}{2}$ $\frac{1}{2}$ | $\frac{1}{2}$ $\frac{1}{2}$ | $\frac{1}{2}$ $\frac{1}{2}$ | $\frac{1}{3}$ $\frac{1}{3}$ | $\frac{1}{4}$ $\frac{1}{4}$ | $\frac{1}{6}$ $\frac{1}{6}$ |
| LOCATION | 1 2 3 | 4 5 | 6 7 | 8 9 10 | 11 12 | 13 14 | 15 16 | 17 18 19 | 20 21 | 22 23 24 |

FIG. 4. SECOND MODIFICATION OF AMPLITUDE SHADING FOR TRANSDUCER WITH 24 ELEMENTS.

one can achieve a favorable optimum combination of (narrow) beam width, (low) side lobe level, (high) system gain, and (favorable) nearfield behavior. Such favorable shading combinations can be determined for any number of array elements. The following table summarizes the results obtained for N=24.

TABLE

| FIG. NO. | none | 1 | 3 | 4 |
|---|---|---|---|---|
| Number of Transducer Elements | 24 | 24 | 24 | 24 |
| n(1) | 24 | 12 | 12 | 0 |
| n(2) | 0 | 2 | 4 | 4 |
| n(3) | 0 | 0 | 0 | 2 |
| n(4) | 0 | 2 | 1 | 1 |
| n(5) | 0 | 0 | 0 | 0 |
| n(6) | 0 | 0 | 0 | 1 |
| −3 db beam width factor = $\frac{L}{\lambda}\sin\left(\frac{BW}{2}\right)$ | 0.443 | 0.592 | 0.558 | 0.548 |
| Highest side lobe level, db | −13.1 | −21.9 | −23.2 | −25.7 |

DESCRIPTION OF THE PREFERRED EMBODIMENTS

FIG. 1 shows a typical example of a prior art embodiment 10 of a shading technique. The table shows the relative amplitude of each section with respect to the location of the various elements.

It will be noted that the various elements, or transducers, are symmetrically located about a line between the middle sections 10C' and 10C''.

FIG. 2 is a pair of graphs 20 showing the directional response of tranducers of 24 elements with two shading techniques, the full line 22 showing the response of the prior art array 10 of FIG. 1, the dotted line 24 showing the array 30 of FIG. 3. Using the methods of this invention the beam width at the −3 dB level is reduced as the highest side lobe levels are also reduced, an unusual accomplishment.

In its broadest form, the invention comprises an array with a plurality of discrete transducers, and which are shaded discretely. The array comprises a plurality of parallel combinations of transducers distributed symmetrically about the middle of the array.

FIG. 3 shows a typical embodiment 30. The array, generally, will comprise 24 transducers, having the relative voltage amplitudes shown. In the embodiment 30, shown in FIG. 3, the central transducers are located in sections 30C' and 30C''. The array 30, generally, will comprise n(1) central transducers having a relative voltage amplitude of one, as indicated by the (1).

A pair of n(2) pluralities, 30B and 30B'', of series combinations of two transducer elements are adjacent at either side of the central transducers, 30C' and 30''. Each transducer element of the n(2) pluralities, 30B' and B'', has a relative voltage amplitude of $\frac{1}{2}$.

Generally, an array may further comprise n(3) pluralities of series combinations of three transducer elements. One plurality would be adjacent at either side of the outermost of the n(2) pluralities, each of the transducer elements having a relative voltage amplitude of $\frac{1}{3}$. In the embodiment 30 shown in FIG. 3, n(3) equals zero, as it does in the prior art embodiment 10 of FIG. 1.

In the general embodiment, the arrays would also include a number n(4) of series of combinations, each series comprising four transducer elements which have a relative voltage amplitude of $\frac{1}{4}$. Whenever the q value is even and the n(q) value is an odd number, the series parallel arrangement is implemented using half of the transducer elements from each end of the array.

In array 30 of FIG. 3, n(4) equals one. Thus, a pair of series combinations, 30A' and 30A'', one at each end of the array, each series comprising two transducer elements, are connected in series with each other so that all elements have a relative voltage amplitude of $\frac{1}{4}$.

The prior art embodiment 10 of FIG. 1 can be understood on the basis of the above explanation of embodiment 30 of FIG. 3.

Referring now to FIG. 4, therein is shown another embodiment 70 of the invention. There, n(1) equals zero, so that there are no transducer elements that are singly connected to the input/output terminals 72. The central elements are n(2)=4 pairs of two transducers in series, each with a relative voltage amplitude of $\frac{1}{2}$. These are shown as 70D', 70E', 70E'' and 70D''.

A pair of series combinations of three transducer elements, located in section 70C' and 70C'', have one combination adjacent at either side to the first-named combinations 70D' and 70D''. Each transducer of Sections 70C' and 70C'', has a relative voltage amplitude of $\frac{1}{3}$.

A pair of series combinations has one series, 70B' or 70B'', adjacent at each side of the last named combinations, 70C' and 70C''. Each series comprises two transducers, each having a relative voltage amplitude loading of $\frac{1}{4}$. One combination 70B' is connected in series with the other combination 70B''.

A pair of series of combinations, located at 70A' and 70A'', are located at each end of the array 70. Each series, 70A' and 70A'', comprises three transducers, each having a relative voltage amplitude loading of 1/6. The two pairs, located in sections 70A' and 70A'', are connected in series.

The array with 24 transducer elements as illustrated and described herein is particularly amenable to shading distributions that achieve favorable performance criteria, as shown in FIG. 5. However, arrays with other numbers of transducer elements can benefit from the shading methods of this invention.

Obviously, many modifications and variations of the present invention are possible in the light of the above teachings, and, it is therefore understood that within the scope of the disclosed inventive concept, the invention may be practiced otherwise than as specifically described.

What is claimed is:

1. A transducer array, generally linear, of a plurality of discrete transducer elements, which are shaded discretely, the array comprising a plurality of parallel combinations of the transducer elements, one end of each combination being connected to a common connection, the other end of each combination being connected to another common connection, the parallel combinations being distributed, that is, positioned, symmetrically about the middle of the array, wherein:

the transducer elements of the two parallel combinations which are positioned at each end of the array are connected serially to each other.

2. The array according to claim 1, wherein:

the plurality of parallel combinations of transducer elements are arranged according to the relation $$N = \sum_{q=1}^{\infty} q\, n(q).$$

DISCRETE AMPLITUDE SHADING FOR LOBE-SUPPRESSION IN DISCRETE ARRAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Amplitude shading techniques for sonar, radio and radar arrays have been under development and in use for decades. This invention applies generally but is particularly relevant to sonar transducers wherein series-parallel elements can provide monotonic symmetric discrete shading.

For purposes of illustration, it will be assumed that the elements, generally transducers, are identical and have identical radiation-impedance loading. Then, four elements in series that are in parallel with three elements in series will each have $\frac{1}{4}$ and $\frac{1}{3}$ amplitude levels respectively. Thus, those seven elements chosen from the discrete sum total of the array have certain discrete amplitudes. It is a special characteristic in these arrays that the discrete amplitudes achieved are related directly to the number and size of elements in the discrete array. Some prior art methods took into consideration optimal choices that are not possible in the discrete amplitude-discrete location array of this invention.

Other prior art methods used discrete amplitude shading for lobe suppression in discrete arrays, but new concepts are required in order to achieve lower side-lobe levels and/or narrower beamwidth combinations.

SUMMARY OF THE INVENTION

This invention relates to arrays which may be linear, rectangular, or circular, but other shapes may also be useful. The array comprises a plurality of discrete transducers which are shaded discretely. The array comprises a plurality of parallel combinations of the transducers, distributed symmetrically about the generally even number of central transducers, distributed as follows.

A number n(1) of central transducer elements each have a relative voltage amplitude of one. In some configurations n(1) may be zero.

A number n(2) of series combinations of two transducer elements are symmetrically located at either side of the central transducer elements, each transducer having a relative voltage amplitude of $\frac{1}{2}$.

Similarly, for a set of integer values of q, there are n(q) combinations with q transducer elements in series within each combination. Each such element has a relative voltage amplitude of 1/q. Even though q may be any value, it will rarely occur that an optimally shaded transducer will comprise combinations with more than six elements in series. The monotonic distribution is achieved by having the n(q+1) combinations, each with q+1 elements in series, located further from the center of the array than the n(q) combinations, each with q elements in series. A symmetric distribution is obtained as described in this application but generally requires that n(q) be even for odd values of q except for the central-most series combination. The choice of values for the n(q) is restricted, since the total number of transducer elements, N, is given by $$N = \sum_{q=1}^{\infty} qn(q)$$

so that only a few n(q) can have non-zero values.

Thus, there are n(1) groups which consist of n(1) transducer elements in the center of the array, with each element in parallel to the transducer's electrical terminals. There are n(2) groups having 2n(2) elements that are symmetrically distributed, half on each side of the center of the array. Similarly, there are other groups with increasingly more elements in series per group.

This invention uses such series-parallel combinations of transducer elements to achieve an optimum set of performance conditions, including low side lobe levels, narrow beam width and other desired criteria. In general, a potential array is evaluated for such performance factors in order to determine the best series-parallel combination. The method of computation of the directional response for a shading distribution is well known. For example, the two-zone shaded radiator is discussed in an applicable manner by G. E. Martin and J. S. Hickman, "Directional Properties of Continuous Plane Radiators with Bizonal Amplitude Shading", J. Acoust. Soc. Am. vol. 27, pp. 1120–1127 (1955). In this report the shading for optimal two-zone lines, rectangles and circles are found. The theory is readily extended for multi-zone discretely shaded arrays.

For illustration purposes, 24-element transducers are described explicitly herein.

OBJECTS OF THE INVENTION

An object of the invention is to provide a discrete array having a directivity pattern with as small (narrow) beam width as possible for a given side lobe level.

Another object of the invention is to provide a discrete array having as low a side lobe level as possible for a given beam width.

Yet another object of the invention is to provide a discrete array having a small combination of side lobe level and given beam width.

Still another object of the invention is to provide a discrete array having discrete shading parameters that cause the shading amplitude as a function of location to be smoother.

These and other objects of the invention will become more readily apparent from the ensuing specification when taken together with the drawings.

BRIEF DESCRIPTION OF THE DRAWINGS

FIG. 1 is a schematic diagram summary of a prior art technique showing shading parameters and resultant major lobe width factor and highest side lobe level.

FIG. 2 is a pair of graphs illustrating the directional response for transducers with shading according to a prior art array and one of the arrays of this invention.

FIG. 3 is a schematic diagram showing a first modification of an amplitude shading technique.

FIG. 4 is a schematic diagram showing a modification of an amplitude shading technique.

FIG. 5 is a pair of graphs which compare the second modification of the array with the same prior art array shown in FIG. 2.

The FIGS. 1–5 all illustrate the techniques of this invention for transducers with 24 elements. FIGS. 1–5 show the fundamental features of this invention. By using the amplitude shading methods of this invention, where N is the total number of transducer elements, n(q) designating the number q of transducer elements in a parallel combination, qn(q) designating the total number of transducer elements in all combinations having q transducer elements in series.

3. The array according to claim 2, wherein the plurality of parallel combinations of the transducers are distributed as follows:

a number n(1) of central transducer elements, $0 \leqq n(1) \leqq 12$, distributed about the center of the array, having a relative voltage amplitude of one; and a number n(2) of pairs, $2 \leqq n(2) \leqq 4$, of series combinations of transducers adjacent at either side to the central transducers, each transducer having a relative voltage amplitude of $\frac{1}{2}$.

4. The array according to claim 3, further comprising:

a number n(3) of pairs, $0 \leqq n(3) \leqq 3$, of series combinations of the transducers, distributed on each side of the last-named series combinations, the n(2) combinations, the transducers having a relative voltage amplitude of $\frac{1}{3}$;

a number n(4) of pairs, $0 \leqq n(4) \leqq 4$, of series combinations of transducers adjacent at either side to the last-named series combinations, each transducer having a relative voltage amplitude of $\frac{1}{4}$; and a number n(6) of pairs, $0 \leqq n(6) \leqq 4$, of series combinations of transducers, distributed at either side to the last named-combinations, each transducer having a relative voltage amplitude of 1/6.

5. The array according to claim 4, wherein:

N is equal to 24.

6. A transducer array, generally linear, of a plurality of discrete transducer elements which are shaded discretely, the array comprising a plurality of parallel combinations of the transducer elements, one end of each combination being connected to a common connection, the other end of each combination, except for the end combinations, being connected to another common connection, the parallel combinations being distributed, that is, positioned, symmetrically about the middle of the array, wherein:

the parallel combinations of transducer elements positioned at each end of the array are connected serially to each other, with the other ends of the serial connections being connected to the other common connection.

7. The array according to claim 6, wherein:

the plurality of parallel combinations of transducer elements are arranged according to the relation $$N = \sum_{q=1}^{\infty} q\, n(q),$$

where N is the total number of transducer elements, n(q) designating the number q of transducer elements in a parallel combination, qn(q) designating the total number of transducer elements in all combinations having q transducer elements in series.

8. The array according to claim 7, wherein the plurality of parallel combinations of the transducers are distributed as follows:

a number n(1) of central transducer elements $0 \leqq n(1) \leqq 12$, distributed about the center of the array, having a relative voltage amplitude of one; and a number n(2) of pairs, $2 \leqq n(2) \leqq 4$, of series combinations of transducers adjacent at either side to the central transducers, each transducer having a relative voltage amplitude of $\frac{1}{2}$.

9. The array according to claim 8, further comprising:

a number n(3) of pairs, $0 \leqq n(3) \leqq 3$, of series combinations of the transducers, distributed on each side of the last-named series combinations, the n(2) combinations, the transducers having a relative voltage amplitude of $\frac{1}{3}$;

a number n(4) of pairs, $0 \leqq n(4) \leqq 4$, of series combinations of transducers adjacent at either side to the last-named series combinations, each transducer having a relative voltage amplitude of $\frac{1}{4}$; and a number n(6) of pairs, $0 \leqq n(6) \leqq 4$, of series combinations of transducers, distributed at either side to the last named-combinations, each transducer having a relative voltage amplitude of 1/6.

10. The array according to claim 9, wherein: N is equal to 24.

* * * * *